US008698046B2

(12) United States Patent
Shimura et al.

(10) Patent No.: US 8,698,046 B2
(45) Date of Patent: Apr. 15, 2014

(54) HEATER AND IMAGE HEATING APPARATUS INCLUDING SAME

(75) Inventors: Yasuhiro Shimura, Yokohama (JP); Koji Nihonyanagi, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/501,402

(22) PCT Filed: Dec. 20, 2010

(86) PCT No.: PCT/JP2010/072725

§ 371 (c)(1),
(2), (4) Date: Apr. 11, 2012

(87) PCT Pub. No.: WO2011/078063

PCT Pub. Date: Jun. 30, 2011

(65) Prior Publication Data

US 2012/0201582 A1 Aug. 9, 2012

(30) Foreign Application Priority Data

Dec. 21, 2009 (JP) ..... 2009-289781
Nov. 19, 2010 (JP) ..... 2010-259294

(51) Int. Cl.
*G03G 15/20* (2006.01)
*H05B 3/03* (2006.01)
*H05B 3/16* (2006.01)

(52) U.S. Cl.
USPC ..... 219/216; 219/539; 219/541; 219/552; 399/329

(58) Field of Classification Search
None
See application file for complete search history.

(56) References Cited

U.S. PATENT DOCUMENTS 5,495,275 A 2/1996 Martinengo
6,084,208 A * 7/2000 Okuda et al. ..... 219/216
6,456,819 B1 * 9/2002 Abe et al. ..... 399/329
(Continued)

FOREIGN PATENT DOCUMENTS

EP 0586063 A2 3/1994
JP 2000228272 A * 8/2000 ..... H05B 3/16
(Continued)

OTHER PUBLICATIONS

Jul. 5, 2010 International Preliminary Report on Patentability accompanied by Written Opinion of the International Searching Authority for corresponding PCT Application No. PCT/JP2010/072725.

*Primary Examiner* — Joseph M Pelham
(74) *Attorney, Agent, or Firm* — Fitzpatrick, Cella, Harper & Scinto

(57) ABSTRACT

The image heating apparatus includes a heater that achieves even heat-generation distribution and suppression of a non-sheet feeding portion temperature increase when an image is printed on a sheet whose size is smaller than a maximum size for the apparatus, and an endless belt, wherein plural heat-generation resistive members having positive temperature coefficients are connected in parallel are provided between first and second conductive members provided along a longitudinal direction of a substrate; plural heat-generation blocks including the plural heat-generation resistive members connected in parallel, are arranged in series along the longitudinal direction; and in the plural heat-generation resistive members included in one of the heat-generation blocks, a heat-generation resistive member arranged at an end portion in the longitudinal direction has a resistivity value higher than that of a heat generation resistive member arranged at a center in the longitudinal direction, or an interval between heat generation resistive members is larger in the end portion.

14 Claims, 14 Drawing Sheets

| | HEAT GENERATION PATTERN | | | | | | | | UNIT |
|---|---|---|---|---|---|---|---|---|---|
| | 1 | 2 | 3 | 4 | 5 | 6 | 7 | 8 | |
| a (WIRE LENGTH) | 1.84 | 1.84 | 1.84 | 1.84 | 1.84 | 1.84 | 1.84 | 1.84 | mm |
| b (WIRE WIDTH) | 0.68 | 0.72 | 0.76 | 0.78 | 0.78 | 0.76 | 0.72 | 0.66 | mm |
| c (WIRE INTERVAL) | 1.38 | 1.38 | 1.38 | 1.38 | 1.38 | 1.38 | 1.38 | 1.38 | mm |
| HEAT RESISTIVITY VALUE | 2.35 | 2.17 | 2.06 | 1.99 | 1.99 | 2.06 | 2.17 | 2.35 | Ω |

(56) References Cited

U.S. PATENT DOCUMENTS

| | | | | |
|---|---|---|---|---|
| 7,630,662 | B2 | 12/2009 | Namiki et al. | |
| 8,126,383 | B2 * | 2/2012 | Kagawa | 399/329 |
| 8,150,304 | B2 * | 4/2012 | Kagawa et al. | 399/329 |
| 8,295,753 | B2 * | 10/2012 | Kagawa | 399/329 |
| 2009/0230114 | A1 * | 9/2009 | Taniguchi et al. | 219/216 |
| 2010/0310267 | A1 | 12/2010 | Shimura et al. | |
| 2011/0280596 | A1 | 11/2011 | Shimura | |
| 2011/0280597 | A1 | 11/2011 | Shimura et al. | |
| 2012/0000897 | A1 | 1/2012 | Shimura | |
| 2012/0121306 | A1 | 5/2012 | Shimura et al. | |

FOREIGN PATENT DOCUMENTS

| | | | | |
|---|---|---|---|---|
| JP | 2001244055 | A * | 9/2001 | H05B 3/14 |
| JP | 2005-209493 | A | 8/2005 | |
| JP | 2007-018912 | A | 1/2007 | |
| JP | 2007025474 | A | 2/2007 | |
| JP | 2009265387 | A * | 11/2009 | |

* cited by examiner

| | HEAT GENERATION PATTERN | | | | | | | | UNIT |
|---|---|---|---|---|---|---|---|---|---|
| | 1 | 2 | 3 | 4 | 5 | 6 | 7 | 8 | |
| a (WIRE LENGTH) | 1.84 | 1.84 | 1.84 | 1.84 | 1.84 | 1.84 | 1.84 | 1.84 | mm |
| b (WIRE WIDTH) | 0.70 | 0.76 | 0.80 | 0.83 | 0.83 | 0.80 | 0.76 | 0.70 | mm |
| c (WIRE INTERVAL) | 1.38 | 1.38 | 1.38 | 1.38 | 1.38 | 1.38 | 1.38 | 1.38 | mm |
| HEAT RESISTIVITY VALUE | 2.23 | 2.06 | 1.95 | 1.89 | 1.89 | 1.95 | 2.06 | 2.23 | Ω |

| | HEAT GENERATION PATTERN | | | | | | | | UNIT |
|---|---|---|---|---|---|---|---|---|---|
| | 1 | 2 | 3 | 4 | 5 | 6 | 7 | 8 | |
| a (WIRE LENGTH) | 1.84 | 1.84 | 1.84 | 1.84 | 1.84 | 1.84 | 1.84 | 1.84 | mm |
| b (WIRE WIDTH) | 0.68 | 0.72 | 0.76 | 0.78 | 0.78 | 0.76 | 0.72 | 0.66 | mm |
| c (WIRE INTERVAL) | 1.38 | 1.38 | 1.38 | 1.38 | 1.38 | 1.38 | 1.38 | 1.38 | mm |
| HEAT RESISTIVITY VALUE | 2.35 | 2.17 | 2.06 | 1.99 | 1.99 | 2.06 | 2.17 | 2.35 | Ω |

| | HEAT GENERATION PATTERN | | | | | | | | UNIT |
|---|---|---|---|---|---|---|---|---|---|
| | 1 | 2 | 3 | 4 | 5 | 6 | 7 | 8 | |
| a (WIRE LENGTH) | 1.84 | 1.84 | 1.84 | 1.84 | 1.84 | 1.84 | 1.84 | 1.84 | mm |
| b (WIRE WIDTH) | 0.77 | 0.77 | 0.77 | 0.77 | 0.77 | 0.77 | 0.77 | 0.77 | mm |
| c (WIRE INTERVAL) | 1.38 | 1.38 | 1.38 | 1.38 | 1.38 | 1.38 | 1.38 | 1.38 | mm |
| HEAT RESISTIVITY VALUE | 2.03 | 2.03 | 2.03 | 2.03 | 2.03 | 2.03 | 2.03 | 2.03 | Ω |

| | HEAT GENERATION PATTERN | | | | | | | | UNIT |
|---|---|---|---|---|---|---|---|---|---|
| | 1 | 2 | 3 | 4 | 5 | 6 | 7 | 8 | |
| a (WIRE LENGTH) | 1.84 | 1.84 | 1.84 | 1.84 | 1.84 | 1.84 | 1.84 | 1.84 | mm |
| b (WIRE WIDTH) | 0.77 | 0.77 | 0.77 | 0.77 | 0.77 | 0.77 | 0.77 | 0.77 | mm |
| c (WIRE INTERVAL) | 1.38 | 1.38 | 1.38 | 1.38 | 1.38 | 1.38 | 1.38 | 1.38 | mm |
| HEAT RESISTIVITY VALUE | 2.03 | 2.03 | 2.03 | 2.03 | 2.03 | 2.03 | 2.03 | 2.03 | Ω |

FIG. 9A
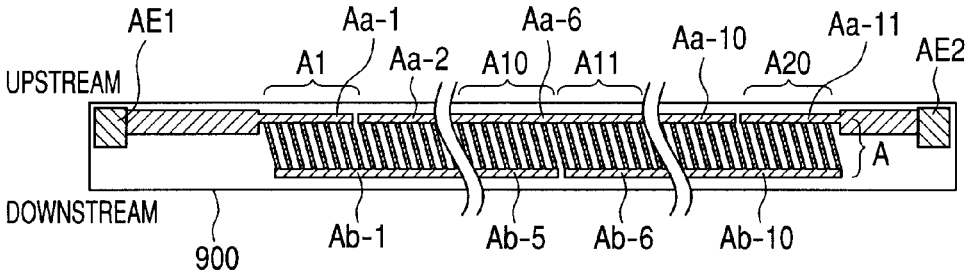
FIG. 9B
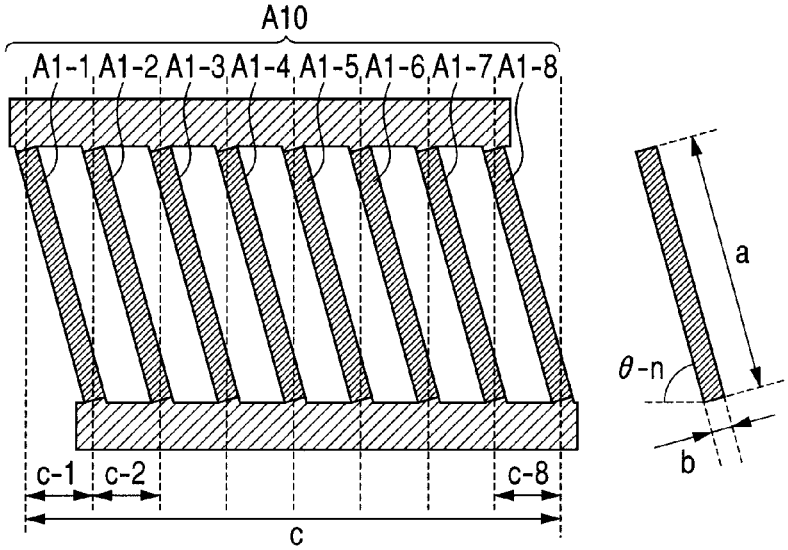
FIG. 9C
| | HEAT GENERATION PATTERN | | | | | | | | UNIT |
|---|---|---|---|---|---|---|---|---|---|
| | 1 | 2 | 3 | 4 | 5 | 6 | 7 | 8 | |
| a (WIRE LENGTH) | 6.32 | 6.30 | 6.29 | 6.28 | 6.28 | 6.29 | 6.30 | 6.32 | mm |
| b (WIRE WIDTH) | 0.70 | 0.70 | 0.70 | 0.70 | 0.70 | 0.70 | 0.70 | 0.70 | mm |
| c (WIRE INTERVAL) | 1.49 | 1.39 | 1.32 | 1.29 | 1.29 | 1.32 | 1.39 | 1.49 | mm |
| HEAT RESISTIVITY VALUE | 4.06 | 4.06 | 4.06 | 4.06 | 4.06 | 4.06 | 4.06 | 4.06 | Ω |

| | HEAT GENERATION PATTERN | | | | | | | | | UNIT |
|---|---|---|---|---|---|---|---|---|---|---|
| | 1 | 2 | ~ | 23 | 24 | 25 | ~ | 46 | 47 | |
| a (WIRE LENGTH) | 1.840 | 1.840 | ~ | 1.840 | 1.840 | 1.840 | ~ | 1.840 | 1.840 | mm |
| b (WIRE WIDTH) | 0.748 | 0.752 | ~ | 0.792 | 0.792 | 0.792 | ~ | 0.752 | 0.748 | mm |
| c (WIRE INTERVAL) | 1.375 | 1.375 | ~ | 1.375 | 1.375 | 1.375 | ~ | 1.375 | 1.375 | mm |
| HEAT RESISTIVITY VALUE | 112.50 | 111.96 | ~ | 106.21 | 106.20 | 106.21 | ~ | 111.96 | 112.50 | Ω |

| | HEAT GENERATION PATTERN | | | | | | | | | UNIT |
|---|---|---|---|---|---|---|---|---|---|---|
| | 1 | 2 | ~ | 23 | 24 | 25 | ~ | 46 | 47 | |
| a (WIRE LENGTH) | 1.840 | 1.840 | ~ | 1.840 | 1.840 | 1.840 | ~ | 1.840 | 1.840 | mm |
| b (WIRE WIDTH) | 0.748 | 0.752 | ~ | 0.792 | 0.792 | 0.792 | ~ | 0.752 | 0.748 | mm |
| c (WIRE INTERVAL) | 1.375 | 1.375 | ~ | 1.375 | 1.375 | 1.375 | ~ | 1.375 | 1.375 | mm |
| HEAT RESISTIVITY VALUE | 112.50 | 111.96 | ~ | 106.21 | 106.20 | 106.21 | ~ | 111.96 | 112.50 | Ω |

HEATER AND IMAGE HEATING APPARATUS INCLUDING SAME

TECHNICAL FIELD

The present invention relates to a heater that can favorably be used in a heat fixing apparatus to be installed in an image forming apparatus such as an electrophotographic copier or an electrophotographic printer, and an image heating apparatus including the heater.

BACKGROUND ART

Embodiments of a fixing apparatus to be installed in a copier or a printer include an endless belt, a ceramic heater that is in contact with an inner surface of the endless belt, and a pressure roller forming a fixing nip portion together with the ceramic heater through the endless belt. Upon performing continuous printing on a small-size sheet with an image forming apparatus including the fixing apparatus, the phenomenon of a gradual temperature increase in portions in the longitudinal direction of the fixing nip portion in which the sheet is not fed (non-sheet feeding portion temperature increase) occurs. If the non-sheet feeding portion has an excessively high temperature, parts in the apparatus may be damaged, and if printing is performed on a large-size sheet in a state in which a non-sheet feeding portion temperature increase has occurred, hot offset of toner may occur in areas corresponding to non-sheet feeding portions for a small-size sheet.

As an method for suppressing this non-sheet feeding portion temperature increase, forming heat generation resistive members on a ceramic substrate of a material having a positive temperature coefficient of resistance and arranging two conductive members on opposite ends in the lateral direction of the substrate so that current flows in the heat generation resistive members in the lateral direction of the heater (recording sheet conveyance direction) has been considered. This is based on the following idea: when a temperature increase occurs in the non-sheet feeding portions, the resistivity values of the heat generation resistive members in the non-sheet feeding portions increase, suppressing the current flowing in the heat generation resistive members in the non-sheet feeding portions, thereby suppressing heat generation in the non-sheet feeding portions. A positive temperature coefficient of resistance, which is a characteristic in which as the temperature increases, the resistance increases, is referred to as "PTC" (positive temperature coefficient) hereinafter.

However, a PTC material has a very low volume resistance, and thus, it is difficult to set the total resistance of the heat generation resistive members in one heater within a range that can be used with a commercial power supply. Therefore, PTC heat generation resistive members formed on a ceramic substrate are segmented into a plurality of heat generation blocks in the longitudinal direction of the heater, and in each heat generation block, two conductive members are arranged at opposite ends in the lateral direction of the substrate so that current flows in the lateral direction of the heater (recording sheet conveyance direction). Furthermore, Japanese Patent Application Laid-Open No. 2005-209493 discloses a configuration in which a plurality of heat generation blocks are electrically connected in series. This literature also discloses connecting a plurality of heat generation resistive members electrically in parallel between two conductive members to configure a heat generation block.

SUMMARY OF INVENTION

Technical Problem

However, it has turned out that the resistivity values of the conductive members are not zero and in one heat generation block, a voltage applied to a heat generation resistive member at the center portion is smaller than a voltage applied to heat generation resistive members at the opposite ends because of the effect of a voltage decrease occurring in the conductive members. Since an amount of heat generated by a heat generation resistive member is proportional to the square of an applied voltage, the heat generation amount will be different between the center portion and the opposite end portions in one heat generation block. Upon occurrence of heat generation unevenness in one heat generation block, the heat generation distribution unevenness in the heater longitudinal direction will also become larger.

Solution to Problem

The present invention for solving the aforementioned problem provides a heater including, a substrate, a heat generation block formed on the substrate, the heat generation block including a first conductive member provided on the substrate along a longitudinal direction of the substrate, a second conductive member provided on the substrate along the longitudinal direction at a position that is different in a lateral direction of the substrate from that of the first conductive member, and a plurality of heat generation resistive members electrically connected in parallel between the first conductive member and the second conductive member, each heat generation resistive member having a positive temperature coefficient of resistance, wherein the heater satisfies at least either of: in the heat generation block, a heat generation resistive member arranged at an end portion in the longitudinal direction has a resistivity value higher than that of a heat generation resistive member arranged at a center in the longitudinal direction; or an interval between the plurality of the heat generation resistive members included in the heat generation block is larger in the end portion in the longitudinal direction than in the center in the longitudinal direction.

Advantageous Effects of Invention

The present invention enables suppression of heat generation distribution unevenness in a heater longitudinal direction.

Further features of the present invention will become apparent from the following description of exemplary embodiments with reference to the attached drawings.

BRIEF DESCRIPTION OF DRAWINGS

FIGS. 9A, 9B and 9C are diagrams illustrating a configuration of a heater in Embodiment 3.

DESCRIPTION OF EMBODIMENTS

Figure 1:
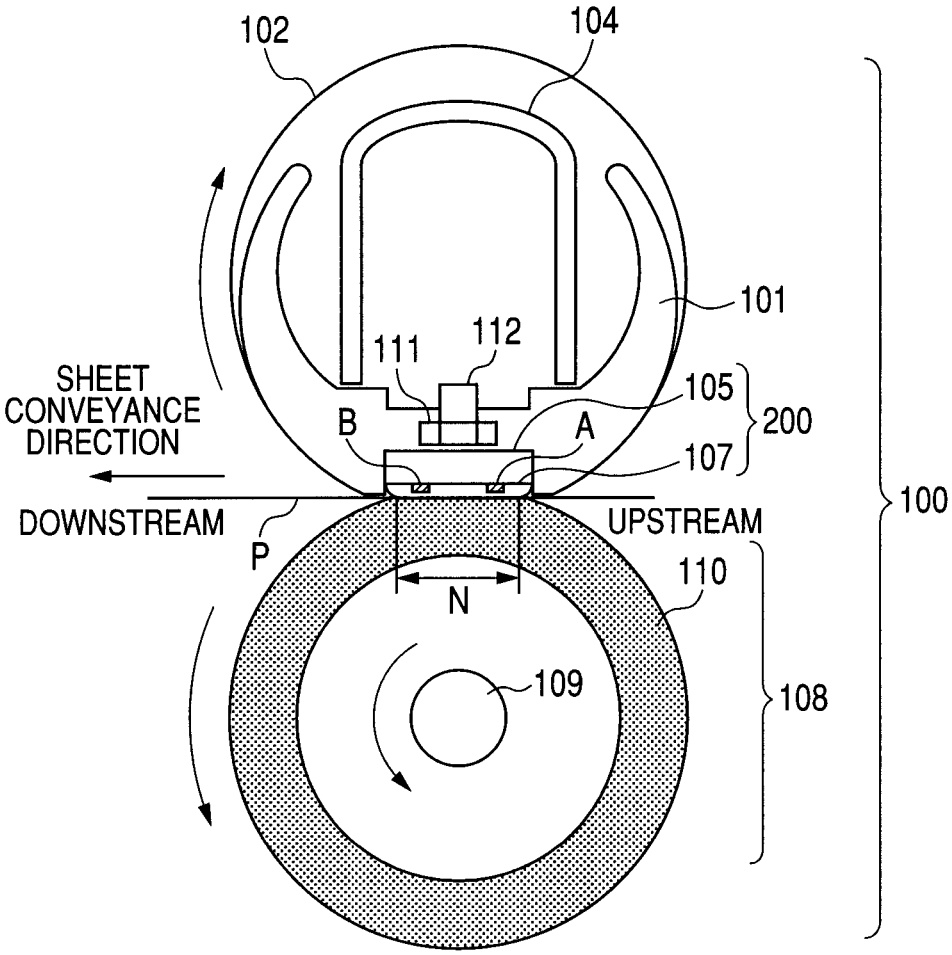
FIG. 1 is a cross-sectional view of an image heating apparatus according to the present invention.

FIG. 1 is a cross-sectional view of a fixing apparatus 100 as an embodiment of an image heating apparatus. The fixing apparatus 100 includes a cylindrical film (endless belt) 102, a heater 200 that is in contact with an inner surface of the film 102, a pressure roller (nip portion forming member) 108 forming a fixing nip portion N together with the heater 200 through the film 102. A material of a base layer of the film may be a high-temperature resin such as polyimide or a metal such as stainless steel.

The pressure roller 108 includes a core bar 109 including a material such as iron or aluminum, and an elastic layer 110 including a material such as silicone rubber. The heater 200 is held by a high-temperature resin holding member 101. The holding member 101 also has a guiding function that guides rotation of the film 102. The pressure roller 108 rotates in a direction indicated by an arrow upon receipt of power from a motor (not illustrated). The film 102 is driven and thereby rotates by rotation of the pressure roller 108.

The heater 200 includes a ceramic heater substrate 105, a heat generation line A (first line) and a heat generation line B (second line) formed on the substrate 105 using heat generation resistive members, and an insulating (glass in the present embodiment) surface protection layer 107 covering the heat generation lines A and B. A temperature detection element 111 such as a thermister contacts a sheet feeding area for a sheet with a minimum usable size (a DL-size envelope with a width of 110 mm in the present embodiment) set in a printer on the back surface side of the heater substrate 105. Power supplied from a commercial power supply to the heat generation lines is controlled according to a temperature detected by the temperature detection element 111.

A recording material (sheet) P bearing an unfixed toner image is heated and thereby subjected to fixing processing while being pinched and conveyed by the fixing nip portion N. A safety element 112, such as a thermo switch, which is activated when the heater has an abnormal temperature increase and blocks the power supply line to the heat generation lines also abuts the back surface of the heater substrate 105. As with the temperature detection element 111, the safety element 112 abuts the sheet feeding area for a sheet with a minimum size. A metal stay 104 is provided for applying pressure caused by a spring (not illustrated) to the holding member 101.

The fixing apparatus in the present embodiment is one to be installed in an A4-size (210 mm×297 mm) printer that also accepts a Letter size (approximately 216 mm×279 mm). In other words, although the fixing apparatus is a fixing apparatus to be installed in a printer that basically longitudinally feeds a A4 sheet (so that the sheet is conveyed with its long sides parallel to the conveyance direction), the fixing apparatus is designed so that the apparatus can also longitudinally feed a Letter-size sheet, which is somewhat larger in width than the A4 size.

Accordingly, the largest size (largest in width) from among the standard recording material sizes that can be accepted by the apparatus (acceptable sheet sizes indicated in the catalog) is the Letter size.

Embodiment 1

Figure 2A:
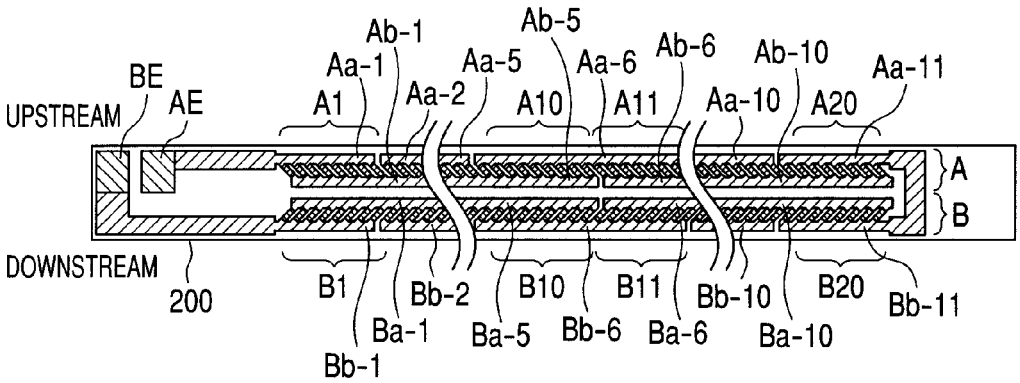
FIGS. 2A, 2B and 2C are diagrams illustrating a configuration of a heater in Embodiment 1.
Figure 2B:
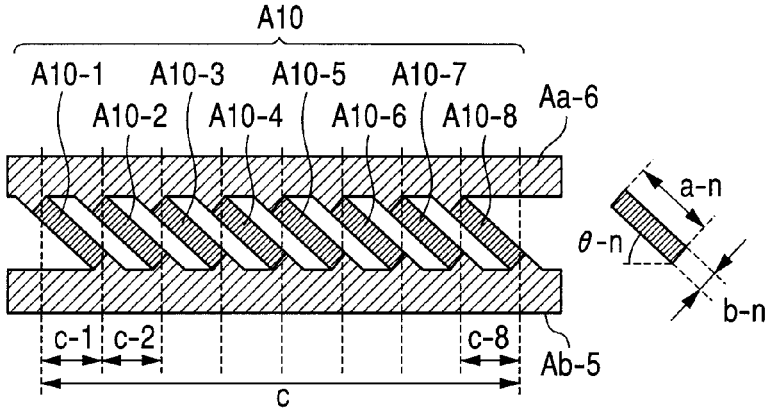
Figure 2C:
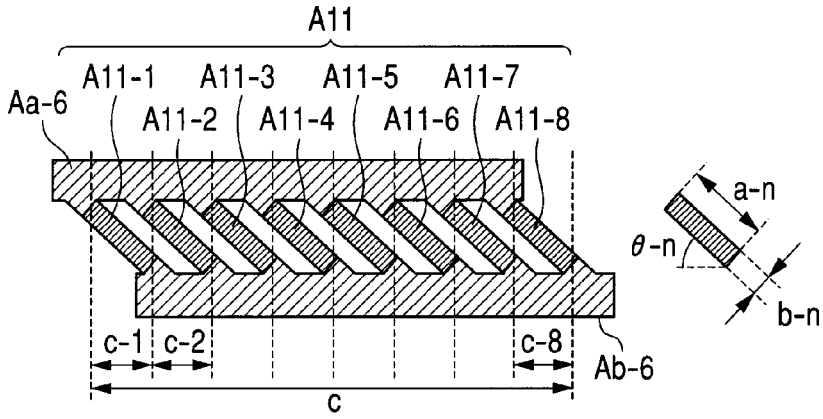

FIGS. 2A to 2C are diagrams for describing the structure of a heater. FIG. 2A is a plan view of a heater, FIG. 2B is an enlarged view illustrating a heat generation block A10 in a heat generation line A, and FIG. 2C is an enlarged view illustrating a heat generation block A11 in the heat generation line A. Both heat generation resistive members in the heat generation line A and heat generation resistive members in the heat generation line B are PTC heat generation resistive members.

The heat generation line A (first line) includes 20 heat generation blocks A1 to A20, and the heat generation blocks A1 to A20 are connected in series. The heat generation line B (second line) also includes 20 heat generation blocks B1 to B20, and the heat generation blocks B1 to B20 are also connected in series.

Furthermore, the heat generation line A and the heat generation line B are electrically connected in series. Power is supplied to the heat generation lines A and B from electrodes AE and BE to which a power supply connector is connected. The heat generation line A includes a conductive trace Aa (first conductive member in the heat generation line A) provided along a substrate longitudinal direction, and a conductive trace Ab (second conductive member in the heat generation line A) provided along the substrate longitudinal direction at a position that is different in a lateral direction of the substrate from that of the conductive trace Aa.

The conductive trace Aa is divided into eleven traces (Aa-1 to Aa-11) in the substrate longitudinal direction. The conductive trace Ab is divided into ten traces (Ab-1 to Ab-10) in the substrate longitudinal direction. As illustrated in FIG. 2B, a plurality of (eight in the present embodiment) heat generation resistive members (A10-1 to A10-8) are electrically connected in parallel between the conductive trace Aa-6, which is a part of the conductive trace Aa, and a conductive trace Ab-5, which is a part of the conductive trace Ab, thereby forming the heat generation block A10.

Also, as illustrated in FIG. 2C, eight heat generation resistive members (A11-1 to A11-8) are electrically connected in parallel between the conductive trace Aa-6 and the conductive trace Ab-6, thereby forming the heat generation block A11. In the heat generation line A, a total of ten heat generation blocks (A2, A4, A6, A8, A10, A12, A14, A16, A18 and A20), each having a configuration similar to that of the heat generation block A10, are provided, and a total of ten heat generation blocks (A1, A3, A5, A7, A9, A11, A13, A15, A17 and A19), each having a configuration similar to that of the heat generation block A11, are provided.

In other words, heat generation blocks similar to the heat generation block A10 and heat generation blocks similar to the heat generation block A11 are alternately connected in series, forming the heat generation line A. The configuration of the heat generation line B is similar to that of the heat generation line A, and thus, a description thereof will be omitted.

As mentioned above, it has turned out that the resistivity values of the conductive members are not zero and in one heat generation block, a voltage applied to a heat generation resistive member at a center portion is smaller than a voltage applied to heat generation resistive members at opposite end portions because of the effect of a voltage decrease occurring in the conductive members. Since an amount of heat generated by a heat generation resistive member is proportional to the square of an applied voltage, the heat generation amount becomes different between the center portion and the opposite end portions in one heat generation block. More specifically, in one heat generation block, the heat generation amounts at the opposite ends of the block are the largest while the heat generation amount at the center portion is small.

Therefore, in the present embodiment, each of a plurality of heat generation resistive members included in one heat generation block is set so that a heat generation resistive member arranged at an end portion in the longitudinal direction has a higher resistivity value compared to the heat generation resistive member arranged in the center in the longitudinal direction.

Also, since the resistivity values of the conductive members are not zero, the heat generation blocks are subject to the effect of heat generation in the conductive members. As illustrated in FIG. 2A, it is necessary to supply power to adjacent heat generation blocks, which are connected in series, so as to make turns in the lateral direction of the heater (in a zig-zag manner); however, in the case of such configuration, conductive members in adjacent heat generation blocks have different heat generation amounts.

For example, between the heat generation block A10 and the heat generation block A11, the amount of heat generated by the conductive traces Ab-5, Aa-6 and Ab-6 is larger in the heat generation block A10 than in the heat generation block A11. A more specific description will be given with reference to FIGS. 4A to 4C and FIGS. 5A to 5C. Therefore, the present embodiment is intended to suppress not only heat generation distribution unevenness in one heat generation block, but also heat generation distribution unevenness occurring between heat generation blocks.

FIG. 2B illustrates a detailed diagram of the heat generation block A10. As illustrated in FIG. 2B, a plurality of (eight in the present embodiment) heat generation resistive members (A10-1 to A10-8) are electrically connected in parallel between the conductive trace Aa-6, which is a part of the conductive trace Aa and the conductive trace Ab-5, which is a part of the conductive trace Ab, thereby forming the heat generation block A10.

The size (line length (a-n)×line width (b-n)), the layout (interval (c-n)) and the resistivity value of each heat generation resistive member in the heat generation block A10 are indicated in FIG. 2B. As illustrated FIG. 2B, each heat generation resistive member is arranged with an oblique inclination (angle θ) relative to the longitudinal direction of the substrate and the recording material conveyance direction.

As illustrated in FIG. 2B, it is defined that a heat generation block length c is a length in the heater longitudinal direction from a center of a short side of a heat generation resistive member at the left end to a center of a short side of a heat generation resistive member at the right end. In the heater 200, in not only the heat generation block A10 but also other heat generation blocks, heat generation resistive member intervals c-1 to c-8 are equal, and each interval is c/8.

The heat generation block A10 has improved evenness of the amounts of heat generated by the heat generation resistive members A10-1 to A10-8 by providing different line widths to the heat generation resistive members in order to provide an even heat generation distribution in the heater longitudinal direction in the heat generation block. In the heat generation block A10, the line widths b-n of the respective heat generation resistive members are set so that heat generation resistive members closer to the center portion (A10-4 and A10-5) have a lower resistivity value while heat generation resistive members closer to the end portions (A10-1 and A10-8) have a higher resistivity value.

The chart illustrated in FIG. 2B indicates the sizes and resistivity values of the eight heat generation resistive members in the heat generation block A10. Here, the lengths (a-n: a-1 to a-8) and the intervals (c-n: c-1 to c-8) of the heat generation resistive members are made to be uniform while the line widths (b-n: b-1 to b-8) are made to be vary, thereby providing an even heat generation distribution in the heat generation block A10. Since the resistivity value of a heat generation resistive member is proportional to the length/line width, as with the line width, the resistivity values of the heat generation resistive members may also be adjusted by providing different lengths to the heat generation resistive members. Also, the resistivity values of the heat generation resistive members may be adjusted by using materials having different sheet resistivity values.

Furthermore, as illustrated in FIG. 2B, each heat generation resistive member is made to have a rectangular shape, enabling provision of a more even distribution of current flowing in the heat generation resistive member. For example, where each heat generation resistive member has a parallelogram shape, since current flows more on the shortest route in a resistive element, a distribution of current flowing in the heat generation resistive member may be biased; however, where each heat generation resistive member has a rectangle shape, current easily flows evenly over the entire heat generation resistive member. However, the effect of suppressing a non-sheet feeding portion temperature increase can also be provided where parallelogram heat generation resistive members are used, and thus, the shape of the heat generation resistive members is not limited to a rectangle.

Furthermore, as illustrated in FIG. 2B, in one heat generation block, a plurality of heat generation resistive members is arranged with an oblique inclination relative to the substrate longitudinal direction and the recording material conveyance direction so as to achieve a positional relationship in which the shortest current route of each of the plurality of heat generation resistive members longitudinally overlaps the shortest current route of a heat generation resistive member adjacent to the heat generation resistive member in the longitudinal direction.

This positional relationship is similarly provided between an end heat generation resistive member in a heat generation block (for example, the rightmost heat generation resistive member A10-8 in the heat generation block A10) and an end heat generation resistive member in an adjacent heat generation block (for example, the leftmost heat generation resistive member A11-1 in the heat generation block A11).

Since each heat generation resistive member in the present embodiment has a rectangle shape, the entire heat generation resistive member is the shortest current path. In the present embodiment, as illustrated in FIG. 2B, the respective heat generation resistive members are arranged so that a center portion of a short side of the rectangle shape of a heat generation resistive member overlaps a center portion of a short side of the rectangle shape of an adjacent heat generation resistive member in the substrate longitudinal direction.

FIG. 2C illustrates a detailed diagram of the heat generation block A11. The apparent structure of the heat generation block A11 is substantially the same as that of the heat generation block A10, and thus, a description thereof will be omitted. As with the heat generation block A10, the heat generation block A11 has improved evenness of the amounts of heat generated by the heat generation resistive members A11-1 to A11-8 by providing different line widths to the heat generation resistive members in order to provide an even heat generation distribution in the heater longitudinal direction in the heat generation block.

In the heat generation block A11, the line widths b-n of the respective heat generation resistive members are set so that heat generation resistive members closer to the center portion (A11-4 and A11-5) have a lower resistivity value while heat generation resistive members closer to the end portions (A11-1 and A11-8) have a higher resistivity value. The chart illustrated in FIG. 2C indicates the sizes and resistivity values of the eight heat generation resistive members in the heat generation block A11.

Here, comparing the heat generation blocks A10 and A11, the resistivity values of the heat generation resistive members in the heat generation block A11 are generally high compared to those of the heat generation block A10. As described above, the amount of heat generated by the conductive traces is larger in the heat generation block A10 than in the heat generation block A11. Accordingly, the amount of heat generated by the heat generation resistive members in the heat generation block A11 is made to be large compared to that of the heat generation block A10 to provide a uniform heat generation amount between the adjacent heat generation blocks.

Figure 3A:
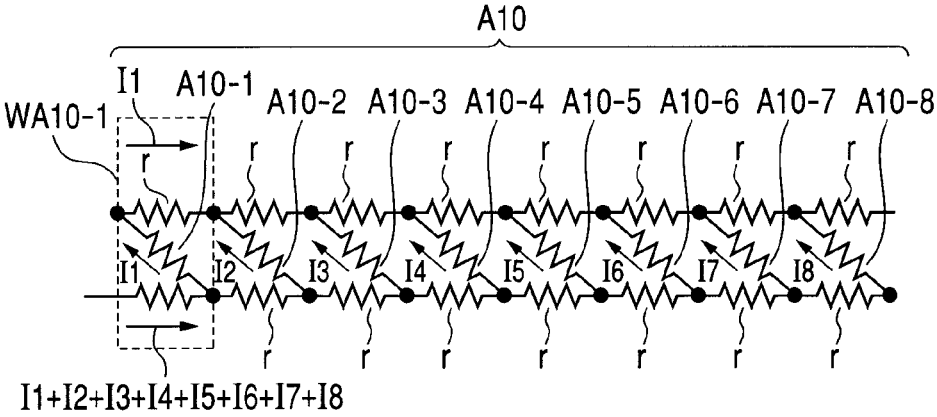
FIGS. 3A and 3B are diagrams illustrating a configuration of a heater in Embodiment 1.
Figure 3B:
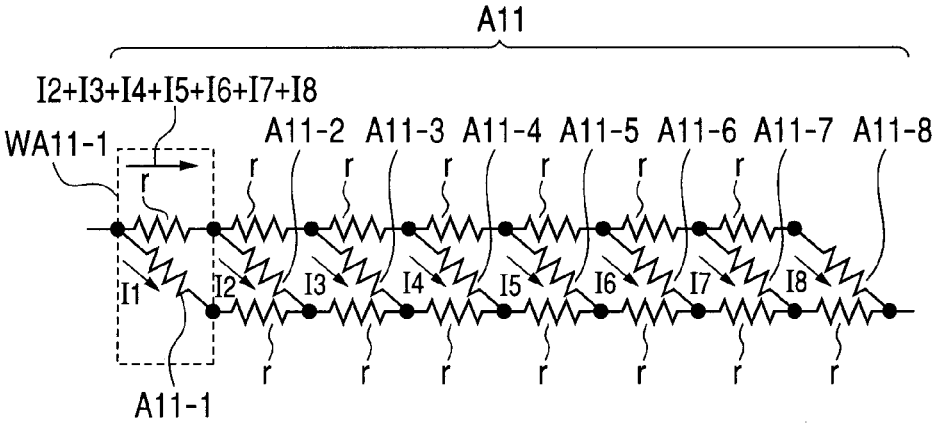
Figure 3C:
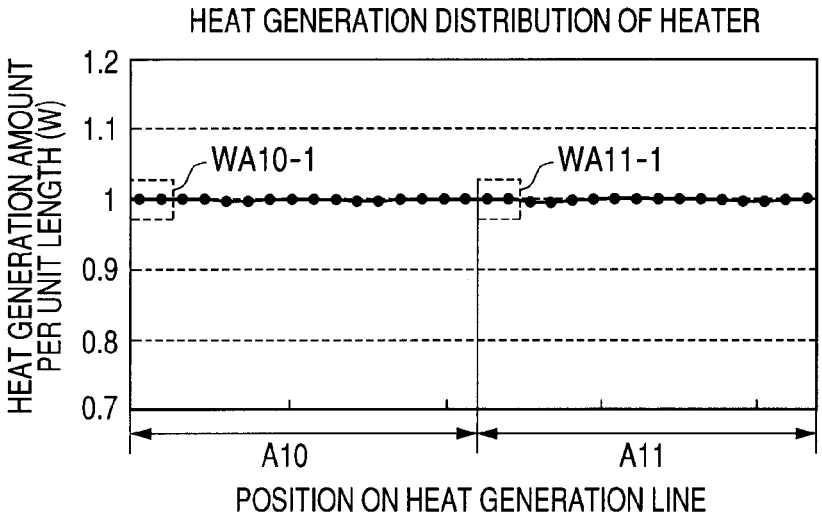
FIG. 3C is a diagram illustrating a heat generation distribution of a heater in Embodiment 1.

FIGS. 3A to 3C illustrate equivalent circuit diagrams of the heat generation blocks A10 and A11, and a simulation result, for describing the effect of providing an even heat generation distribution in the heater longitudinal direction of the heater 200. FIGS. 3A and 3B are equivalent circuit diagrams for calculating heat generation distributions in the heat generation blocks A10 and A11. It is assumed that the sheet resistivity value of each conductive trace in the heater 200 is 0.005Ω/□, the sheet resistivity value of each heat generation resistive member is 0.85Ω/□, and the resistance-temperature coefficient of each heat generation resistive member is 1000 ppm. The resistivity values of the heat generation resistive members are values indicated in FIGS. 2A to 2C. The resistivity values of the heat generation resistive members are values at 200° C.

Providing a simplified condition that opposite ends of adjacent heat generation resistive members in a heat generation block are connected via conductive traces with a line length of 1.4 mm and a line width of 1 mm, the resistivity value of each conductive trace r connecting the heat generation resistive members is 0.007Ω. Heat generation distributions of the heat generation blocks A10 and A11 were simulated under the above condition.

FIG. 3C is a result of a simulation of a heat generation distribution in the heater 200 under the above condition. The heat generation amount (ordinate axis) indicated in FIG. 3C is a total value of the amounts of heat generated by the conductive traces and the heat generation resistive members in each heat generation block. As a result of the simulation, the higher/lower limit values of the heat generation distributions fall within the range of not more than ±0.2%, and thus, the heater 200 achieved an even heat generation distribution in the longitudinal direction of the heater substrate.

Figure 4A:
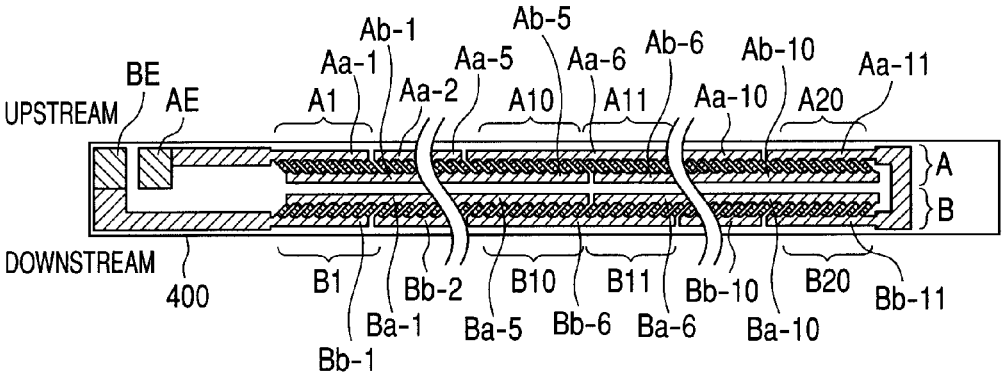
FIGS. 4A and 4B are diagrams illustrating a configuration of a heater in a comparative example.
Figure 4B:
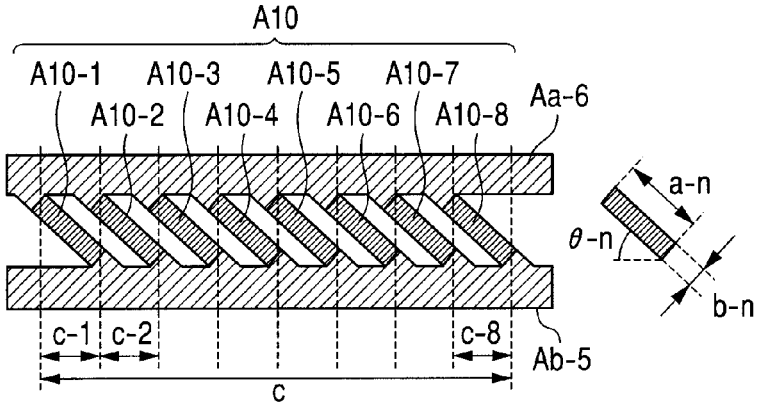
Figure 4C:
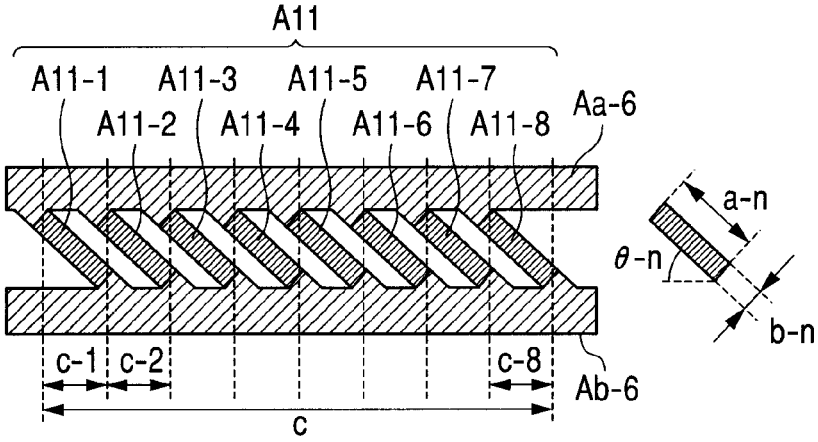
FIG. 4C is a diagram illustrating a heat generation distribution of a heater in a comparative example.

FIG. 4A illustrates a comparative example (heater 400) for describing the effect of providing an even heat generation distribution in the heater longitudinal direction of the heater 200. A description of parts corresponding to the description of the heater 200 will be omitted. The heater 400 does not use a resistivity value adjustment method for heat generation resistive members, which has been described with reference to FIGS. 2A to 2C and FIGS. 3A to 3C, but as illustrated in FIGS. 4B and 4C, the resistivity values of all the heat generation resistive members are set to be equal (2.03Ω).

Figure 5A:
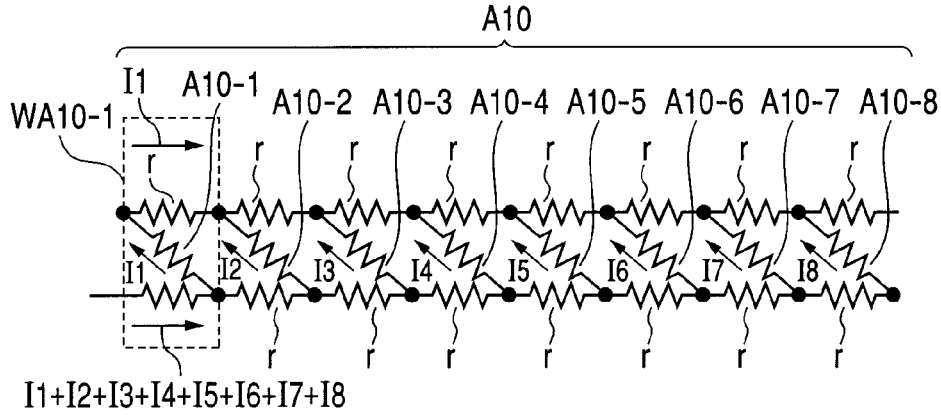
FIGS. 5A and 5B are diagrams illustrating a configuration of a heater in a comparative example.
Figure 5B:
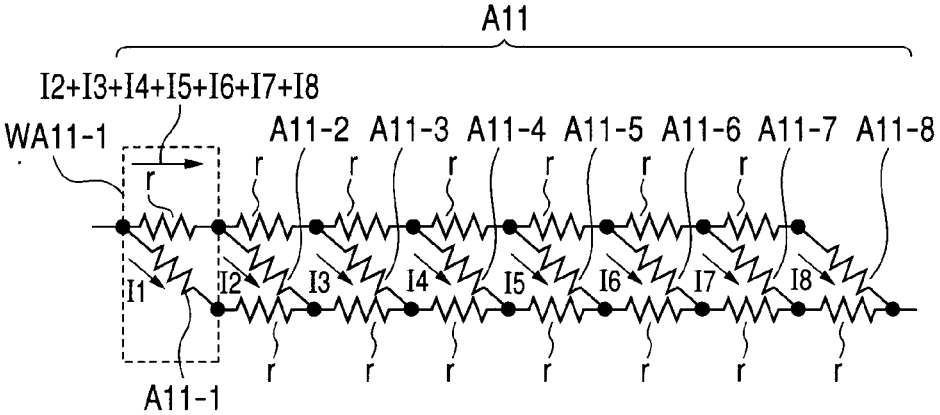
Figure 5C:
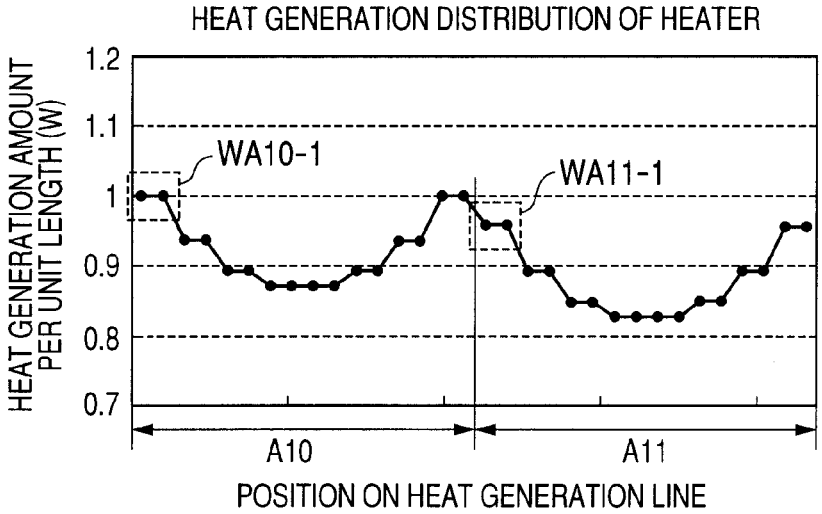
FIG. 5C is a diagram illustrating a heat generation distribution of a heater in a comparative example.

FIGS. 5A to 5C illustrate equivalent circuit diagrams of the heater 400, and a simulation result. FIGS. 5A and 5B are equivalent circuit diagrams for calculating heat generation distributions of heat generation blocks A10 and A11. It is assumed that the sheet resistivity value of each conductive trace is 0.005Ω/□, the sheet resistivity value of each heat generation resistive member is 0.85Ω/□, and the resistance-temperature coefficient of each heat generation resistive member is 1000 ppm in the heater 400. The resistivity values of the heat generation resistive members are the values indicated in FIGS. 4A to 4C. The resistivity values of the heat generation resistive members are values at 200° C. Providing a simplified condition that opposite ends of adjacent heat generation resistive members in a heat generation block are connected via conductive traces with a line length of 1.4 mm and a line width of 1 mm, the resistivity value of each conductive trace r connecting the heat generation resistive members is 0.007Ω. Heat generation distributions of heat generation blocks A10 and A11 were simulated under the above condition.

FIG. 5C is a simulation result of heat generation distributions in a heater 400. From the simulation result, it can be seen that the upper/lower limit values of the heat generation distributions fall within a larger range of +8.5% to −6%. As illustrated in FIGS. 5A to 5C, the heater 400 causes temperature unevenness in the heater longitudinal direction. A more specific description of the reason for causing heat generation unevenness will be given below.

As illustrated in the equivalent circuit diagram of the heat generation block A10 in FIG. 5A and the equivalent circuit diagram of the heat generation block A11 in FIG. 5B, where the resistivity value of each conductive trace connecting heat generation resistive members (A10-1 to A10-8) and heat generation resistive members (A11-1 to A11-8) in parallel is r, the amount of heat generated by the conductive traces in an area WA10-1 in the heat generation block A10 where the heat generation resistive member A10-1 is present is a total value of the product of the resistivity value of a conductive trace Aa-6 and the square of the value of current flowing in the conductive trace Aa-6 ($=r\times I1^2$) and the product of the resistivity value of a conductive trace Ab-5 and the square of the value of current flowing in a conductive trace Aa-5 ($=r\times(I1+I2+I3+I4+I5+I6+I7+I8)^2$). The amount of heat generated by the conductive trace in an area WA11-1 in the heat generation block A11 where the heat generation resistive member A11-1 is present is the product of the resistivity value of the conductive trace Aa-6 and the square of the value of current flowing in the conductive trace Aa-6 ($=r\times(I2+I3+I4+I5+I6+I7+I8)^2$).

It can be seen that when current flows in one heater longitudinal direction in the heat generation block A10, since the heat generation block A10 has a return current route in which current flows in an opposite direction, the heat generation block A10 has a larger amount of heat generated by the conductive traces compared to that of the heat generation block A11. The amounts of heat generated by the conductive traces in the areas in the heat generation block A10 where the heat generation resistive members A10-2 to A10-8 are present are larger than the amounts of heat generated by the conductive traces in the areas in the heat generation block A11 where the heat generation resistive members A11-2 to A11-8 are present.

In a heat generation line A, the amounts of heat generated by conductive traces in heat generation blocks A2, A4, A6, A8, A10, A12, A14, A16, A18 and A20 are large compared to the amounts of heat generated by conductive traces in heat generation blocks A1, A3, A5, A7, A9, A11, A13, A15, A17 and A19. A heat generation line B is similar to the above. As described above, in the heater 400, heat generation blocks with a small amount of heat generated by the conductive traces, and heat generation blocks with a large amount of heat generated by the conductive traces are alternately connected. As described above, depending on the heat generation unevenness occurring in one heat generation block or heat generation unevenness occurring between a plurality of heat generation blocks, heat generation distribution unevenness in the heater longitudinal direction also becomes large.

Therefore, in the present embodiment, as illustrated in FIGS. 2A to 2C, a plurality of heat generation resistive members in one heat generation block are set so that a heat generation resistive member arranged at an end portion in the longitudinal direction has a resistivity value higher than that of a heat generation resistive member arranged at a center in the longitudinal direction. Furthermore, the plurality of heat generation resistive members are configured so that the heat generation resistive members are arranged with an oblique inclination relative to the longitudinal direction and each of the plurality of heat generation resistive members included in one heat generation block has a resistivity value that is different from that of an adjacent one of the heat generation blocks. This configuration enables suppression of not only heat generation distribution unevenness in one heat generation block, but also a difference in heat generation amount between adjacent heat generation blocks.

Figure 6:
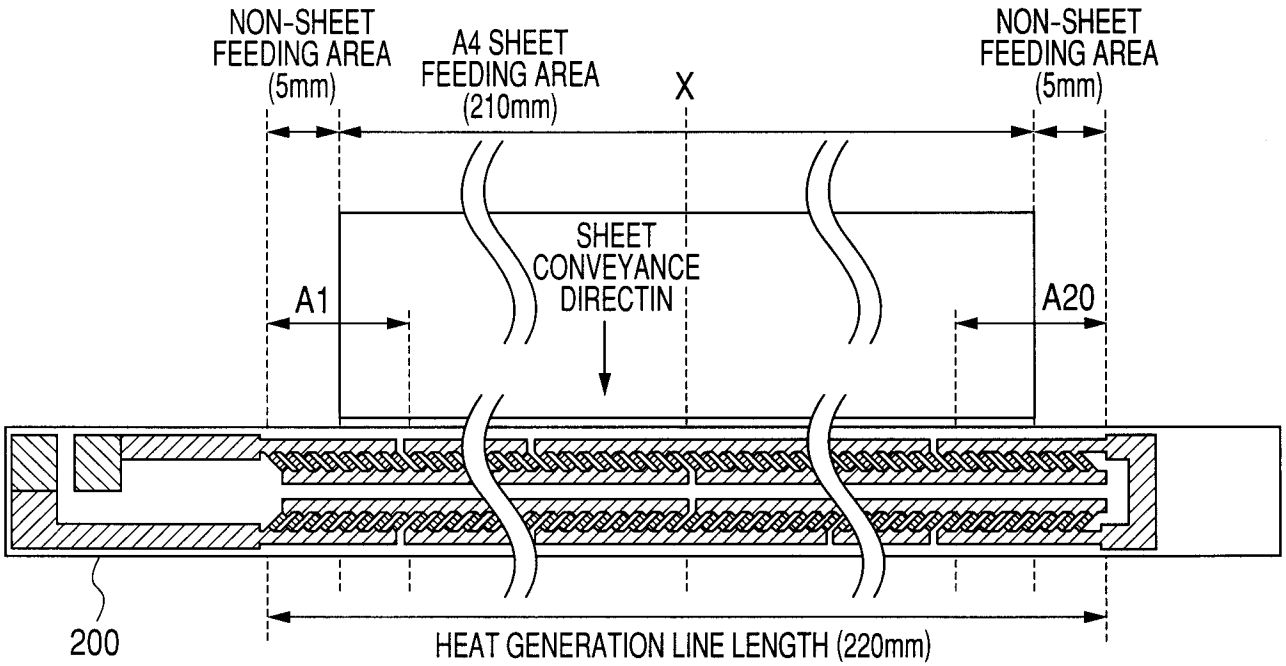
FIG. 6 is a diagram illustrating a relationship of a heater in Embodiment 1 with sheet size.

FIG. 6 is a diagram for describing a non-sheet feeding portion temperature increase in the heater 200. This heater is arranged so that a center portion of the area in which the heat generation resistive members are provided (heat generation line length) conforms to a recording material conveyance reference line X in the printer in the substrate longitudinal direction. The present embodiment has been described in terms of an embodiment for the case where an A4-size (210 mm×297 mm) sheet is longitudinally fed (so that the 297 mm sides are parallel to the conveyance direction), and the heater is installed in a printer that conveys a recording material so that a center of the 210 mm sides of an A4-size sheet conforms to the reference line X.

In order to accept a longitudinally-fed US-Letter sheet (approximately 216 mm×279 mm), the heater 200 has a heat generation line length of 220 mm. Here, as described above, a printer including a fixing apparatus in the present embodiment is basically a printer for the A4 size although the printer accepts the Letter size. Accordingly, the printer is one for users who use A4-size sheets most frequently.

However, since the printer accepts the Letter size as well, when printing is performed on an A4-size sheet, a non-sheet feeding area of 5 mm is caused at opposite ends of the heat generation lines. During fixing processing, the power supply to the heater is controlled so that the temperature detected by the temperature detection element 111 that detects a heater temperature around the recording material conveyance reference line X is maintained at a control target temperature. Accordingly, in the non-sheet feeding portions, the heat is not absorbed by the sheet, resulting in a temperature increase in the non-sheet feeding portions compared to the sheet feeding portion.

Figure 7A:
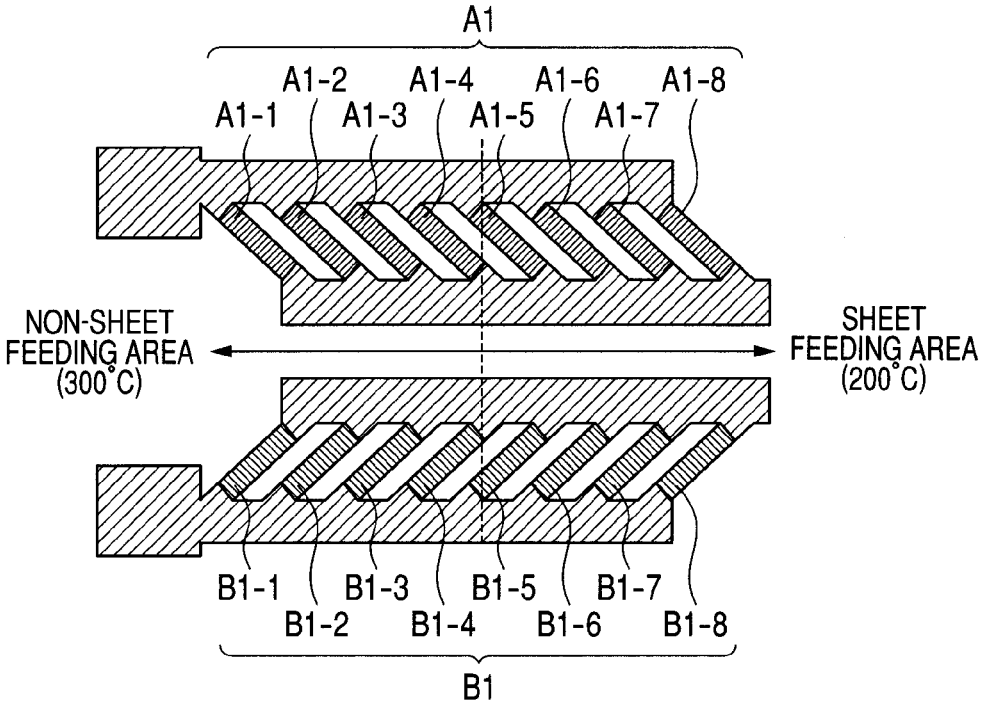
FIGS. 7A and 7B are diagrams illustrating a non-sheet feeding portion temperature increase suppression effect of a heater in Embodiment 1.
Figure 7B:
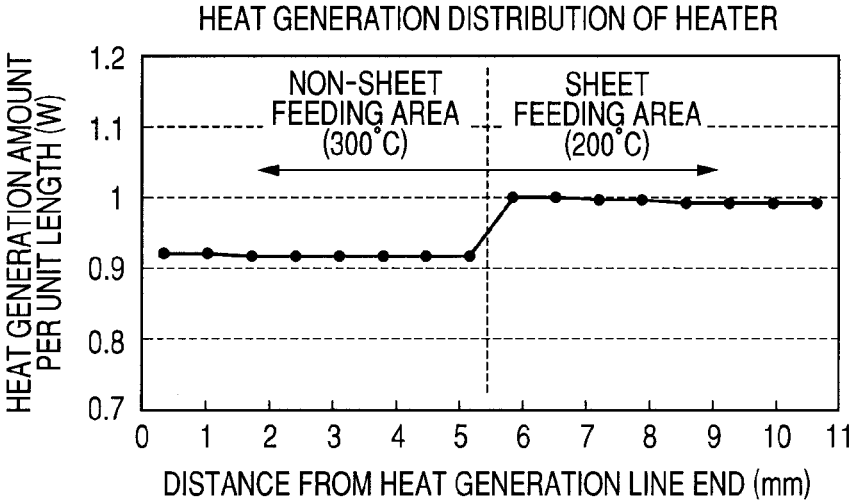

In the present embodiment, the Letter size is the maximum size and the A4 size is the specific size. FIGS. 7A and 7B indicate simulation results for describing an effect of the heater 200 in suppressing a non-sheet feeding portion temperature increase. The configurations of the heat generation blocks A1 and B1 in FIG. 7A correspond to that of the heat generation block A11 described with reference to FIG. 3B.

Here, a simulation is performed for a state in which the temperature of the sheet feeding area is controlled at 200° C. while the temperature of the non-sheet feeding area increases to 300° C. Where the heat generation resistive member temperature of the non-sheet feeding portions reaches a temperature of 300° C. or more, which is the upper temperature limit for, e.g., the roller portion 110, which includes a heat-resisting rubber elastic element, in the pressure roller 108, the film 102 and the film guide 101, the fixer may be damaged. Therefore, the temperature in the non-sheet feeding portion temperature increase is set 300° C. There is no particular limitation on the above set temperature because the set temperature varies depending on the material and/or configuration.

Also, although in reality, continuous temperature distribution is present in the non-sheet feeding area and sheet feeding area end portions, for simplification, it is assumed that the boundary between a non-sheet feeding area and a sheet feeding area is provided between heat generation resistive members A1-4 and A1-5 in a heat generation line A (heat generation resistive members B1-4 and B1-5 in a heat generation line B), the temperature of the sheet feeding area is 200° C. and the temperature of the non-sheet feeding area is 300° C.

In the non-sheet feeding area where the temperature has increased to 300° C., the resistivity values of heat generation resistive members A1-1 to A1-4 and the resistivity values of heat generation resistive members B1-1 to B1-4 have respectively increased by 10% compared to those at 200° C. owing to the effect of the resistance-temperature coefficient. Since conductive traces have a low resistivity value, and thus, is less affected by the resistance-temperature coefficient, no resistance change depending on the temperature is considered for the conductive traces in this simulation.

FIG. 7B is a simulation result indicating a heat generation distribution at an end of the heater 200 under the above conditions. From the simulation results, it can be seen that in the heater 200, the heat generation amount in the non-sheet feeding area is small compared to that of the sheet feeding area. The ordinate axis of the Figure indicates the heat generation amount per unit length in the heater longitudinal direction, which is the total of the amounts of heat generated by the heat generation resistive members and the conductive traces. In the heat generation blocks A1 and B1, it can be seen that the average heat generation amount per unit length of the non-sheet feeding area is reduced by approximately 8% compared to the average of the sheet feeding area.

When a temperature difference is caused by a non-sheet feeding portion temperature increase in a region within one heat generation block, the resistivity values of the heat generation resistive members in the non-sheet feeding portion increase, enabling reduction of an amount of current flowing in the heat generation resistive members in the non-sheet feeding area. Accordingly, a non-sheet feeding portion temperature increase can be suppressed. An optimum heat generation resistive member shape varies depending on the condition such as the sheet resistivity value of the conductive traces and/or the minimum feature size of the heat generation resistive members.

The present embodiment has been described in terms of an embodiment under the aforementioned conditions. Although the above simulation has been described for the heat generation amount when the temperature of the non-sheet feeding portion area becomes 300° C., the heater 200 enables suppression of a temperature increase in a non-sheet feeding portion area. When there is a temperature increase in a non-sheet feeding area, as illustrated in FIGS. 7A and 7B, the heater 200 suppresses the heat generation amount in the non-sheet feeding area, enabling suppression of a temperature increase in the non-sheet feeding portion.

As described above, use of the heater 200 in Embodiment 1 of the present proposal enables provision of a heater enabling suppression of a non-sheet feeding portion temperature increase and improvement of evenness of a heat generation distribution in a sheet feeding area, and an image heating apparatus including the heater.

Embodiment 2

Next, Embodiment 2 in which changes have been made to a heater to be installed in an image heating apparatus will be described. A description of components similar to those in Embodiment 1 will be omitted.

Figure 8:
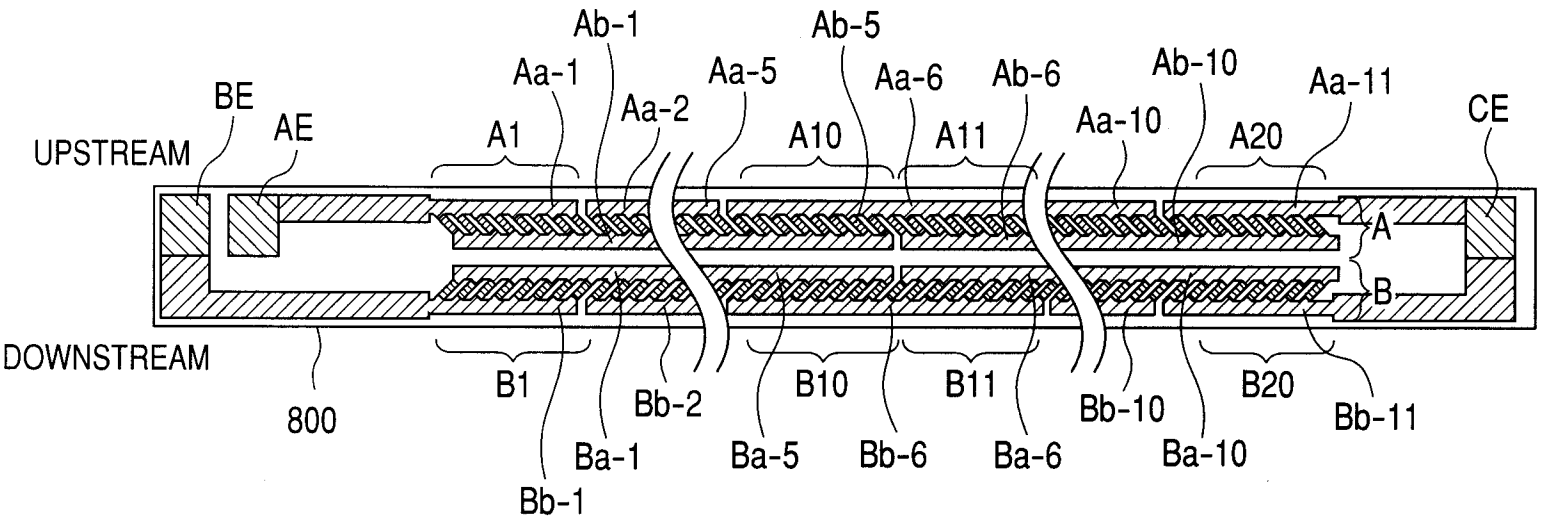
FIG. 8 is a diagram illustrating a configuration of a heater in Embodiment 2.

FIG. 8 is a diagram illustrating a configuration of a heater 800 in Embodiment 2. The heater 800 is configured so that a heat generation line A (first line) and a heat generation line B (second line) can separately be driven by two heater drive circuits, and for that purpose, an electrode CE is added to the heater 200 in Embodiment 1 between the heat generation lines A and B. Power is supplied to the heat generation line A via an electrode AE and the electrode CE, and power is supplied to the heat generation line B via electrode BE and the electrode CE. The configuration is the same as that of the heater 200 except the addition of the electrode CE.

As described above, the present invention can also be applied to a heater configured so that heat generation lines A and B can separately be controlled.

Embodiment 3

Next, Embodiment 3 in which changes have been made to a heater to be installed in an image heating apparatus will be described. A description of components similar to those in Embodiment 1 will be omitted.

FIGS. 9A to 9C are configurations of a heater 900 in Embodiment 3. The heater 900 is configured to include only the heat generation line A (first line) in the heater 200, and includes electrodes AE1 and AE2. Power is supplied to the heat generation line A via the electrode AE1 and the electrode AE2. The method for providing an even heat generation distribution in the heater longitudinal direction, which has been described for the heater 200 in Embodiment 1, can be used for the case where there is only one heat generation line.

FIG. 9B is a detailed diagram of a heat generation block A1 in the heater 900. In the heat generation block A1, eight heat generation resistive members, i.e., from a heat generation resistive member A1-1 with a line length a-1, a line width b-1 and an inclination θ-1 to a heat generation resistive member A1-8 with a line length a-8, a line width b-8 and an inclination θ-8 are arranged at intervals c-1 to c-8, and connected in parallel via conductive traces. The chart illustrated in FIG. 9C indicates an embodiment of a method for adjusting the resistivity values in the heat generation block A-1.

Here, the intervals between the heat generation resistive members are made to be variable, thereby providing an even heat generation distribution in the heat generation block. In order to adjust the intervals between the heat generation resistive members, the inclinations and the lengths of the heat generation resistive member are adjusted. In the heater 900, the ratio of the line length a and the line width b is fixed for the heat generation resistive members, with the result that the heat generation resistive members 1 to 8 included in the heat generation block have a same resistivity value.

Embodiment 4

Figure 10A:
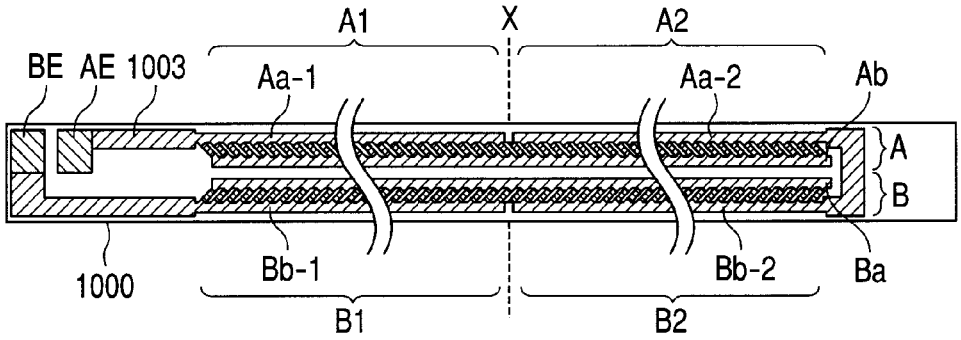
FIGS. 10A, 10B and 10C are diagrams illustrating a configuration of a heater in Embodiment 4.
Figure 10B:
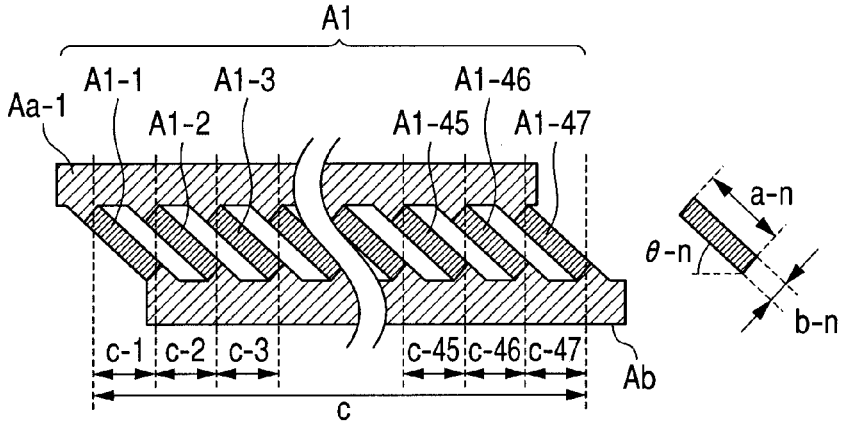
Figure 10C:
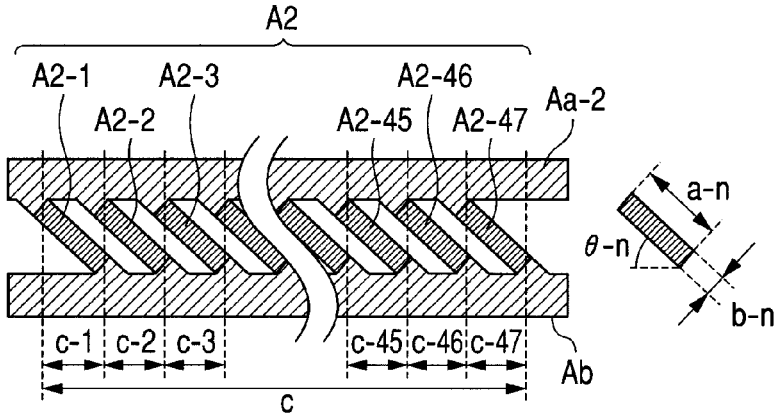

Next, Embodiment 4 in which changes have been made to a heater to be installed in an image heating apparatus will be described. A description of components similar to those in Embodiment 1 will be omitted. FIGS. 10A to 10C are diagrams illustrating a configuration of a heater 1000 in Embodiment 4. The heater 1000 uses PTC heat generation resistive members having a relatively high resistivity value compared to those of the heater 200 described in Embodiment 1.

FIG. 10A is a plan view of a heater, FIG. 10B is an enlarged view illustrating a heat generation block A1 in a heat generation line A, and FIG. 10C is an enlarged view illustrating a heat generation block A2 in the heat generation line A. Both the heat generation resistive members in the heat generation line A and the heat generation resistive members in a heat generation line B are PTC heat generation resistive members.

The heat generation line A (first line) includes two heat generation blocks A1 and A2, and the heat generation blocks A1 and A2 are connected in series. The heat generation line B (second line) also includes two heat generation blocks B1 and B2, and the heat generation blocks B1 and B2 are also connected in series. Furthermore, the heat generation line A and the heat generation line B are electrically connected in series. Power is supplied to the heat generation lines A and B via electrodes AE and BE to which a power supply connector is connected. The heat generation line A includes a conductive trace Aa (first conductive member for the heat generation line A) provided along a substrate longitudinal direction and a conductive trace Ab (second conductive member for the heat generation line A) provided along the substrate longitudinal direction at a position that is different in a lateral direction of the substrate from that of the conductive trace Aa.

The conductive trace Aa is divided into two traces (Aa-1 and Aa-2) in the substrate longitudinal direction. As illustrated in FIG. 2B, a plurality of (47 in the present embodiment) heat generation resistive members (A1-1 to A1-47) are electrically connected in parallel between the conductive trace Aa-1, which is a part of the conductive trace Aa, and the conductive trace Ab, thereby forming the heat generation block A1. Also, as illustrated in FIG. 10C, 47 heat generation resistive members (A2-1 to A2-47) are electrically connected in parallel between the conductive trace Aa-2 and the conductive trace Ab, thereby forming the heat generation block A2. In other words, the heat generation block A1 and the heat generation block A2 are connected in series, forming the heat generation line A. The configuration of the heat generation line B is similar to that of the heat generation line A, and thus, a description thereof will be omitted.

When heat generation resistive members having a high resistivity value are used, if the heat generation block length is long, in one heat generation block, a voltage applied to a heat generation resistive member at a center portion is also smaller than a voltage applied to heat generation resistive members at opposite end portions because of the effect of an voltage decrease occurring in the conductive members as described above. Since an amount of heat generated by a heat generation resistive member is proportional to the square of an applied voltage, the heat generation amount becomes different between the center portion and the opposite end portions in one heat generation block. More specifically, in one heat generation block, the heat generation amounts at the opposite ends of the block are the largest while the heat generation amount at the center portion is small.

Therefore, in the present Embodiment 4, each of a plurality of heat generation resistive members included in one heat generation block is set so that a heat generation resistive member arranged at an end portion in the longitudinal direction has a higher resistivity value compared to the heat generation resistive member arranged in the center in the longitudinal direction.

FIG. 10B is a detailed diagram of the heat generation block A1. As illustrated in FIG. 10B, a plurality of (47 in the present embodiment) heat generation resistive members (A1-1 to A1-47) are electrically connected in parallel between the conductive trace Aa-1, which is a part of the conductive trace Aa, and the conductive trace Ab, thereby forming the heat generation block A1.

The size (line length (a-n)×line width (b-n)), the layout (interval (c-n)) and the resistivity value of each heat generation resistive member in the heat generation block A1 are indicated in FIG. 10B. As illustrated in FIG. 10B, each heat generation resistive member is arranged with an oblique inclination (angle θ) relative to the longitudinal direction of the substrate and the recording material conveyance direction. Here, as illustrated in FIG. 10B, it is defined that a heat generation block length c is a length in the heater longitudinal direction from a center of a short side of a heat generation resistive member at the left end to a center of a short side of a heat generation resistive member at the right end. In the heater 1000, not only in the heat generation block A1 but also in other heat generation blocks, heat generation resistive member intervals c-1 to c-47 are equal, and each interval is c/47.

The heat generation block A1 has improved evenness of the amounts of heat generated by the heat generation resistive members A1-1 to A1-47 by providing different line widths to the heat generation resistive members in order to provide an even heat generation distribution in the hear longitudinal direction in the heat generation block. In the heat generation block A1, the line widths b-n of the respective heat generation resistive members are set so that a heat generation resistive member closer to the center portion (A1-24) has a lower resistivity value while a heat generation resistive member closer to the end portions (A1-1 and A1-47) have a higher resistivity value.

The chart illustrated in FIG. 10B indicates the sizes and resistivity values of the 47 heat generation resistive members in the heat generation block A1. Here, the lengths (a-n: a-1 to a-47) and intervals (c-n: c-1 to c-47) of the heat generation resistive members are made to be uniform while the line widths (b-n: b-1 to b-47) are made to vary, thereby providing an even heat generation distribution in the heat generation block A1. Since the resistivity value of a heat generation resistive member is proportional to the length/line width, as with the line width, the resistivity values of the heat generation resistive members may also be adjusted by providing different lengths to the heat generation resistive members. Also, the resistivity values of the heat generation resistive members may be adjusted by using materials having different sheet resistivity values. Also, as described in Embodiment 3, the intervals c may be adjusted while the resistivity values of the heat generation resistive members are made to be uniform.

The total resistivity value of the heater 1100 is 9.52Ω, the resistivity value of the heat generation blocks A1 and A2 is 2.38Ω, and the sheet resistivity value of the resistive heat generation members is 23.1Ω/□. Although the heater 200 described in Embodiment 1 uses heat generation resistive members used in conventional image heating apparatuses, the heater 1000 uses a PTC heat generation resistive material, such as ruthenium oxide ($RuO_2$), having a high volume resistance compared to heat generation resistive members that have been used as heat generation members for conventional image heating apparatuses.

FIG. 10C illustrates a detailed diagram of the heat generation block A2. The apparent structure of the heat generation block A2 is substantially the same as that of the heat generation block A1, and thus, a description thereof will be omitted. As with the heat generation block A1, the heat generation block A2 has improved evenness of the amounts of heat generated by the heat generation resistive members A2-1 to A2-47 by providing different line widths to the heat generation resistive members in order to provide an even heat generation distribution in the heater longitudinal direction in the heat generation block.

The heater 1000 is arranged so that a center portion of the area in which the heat generation resistive members are provided (heat generation line length) conforms to a recording material conveyance reference line X in the printer in the substrate longitudinal direction. The present embodiment has been described in terms of an embodiment for the case where a US-Letter sheet (approximately 216 mm×279 mm) is laterally fed (so that the 216 mm sides are parallel to the conveyance direction), and the heater is installed in a printer that conveys a recording material so that a center of the 279 mm sides of an US-Letter-size sheet conforms to the reference line X.

In order to accept a longitudinally-fed A3-size (297 mm×420 mm) sheet, the heater 1000 has a heat generation line length of 307 mm. Here, as described above, a printer including a fixing apparatus in the present embodiment is basically a printer for the US-Letter size although the printer accepts the A3 size. Accordingly, the printer is one for users who use US-Letter-size sheets most frequently. In the present embodiment, the A3 size is the maximum size and the Letter size is the specific size.

As described above, use of the heater 1000 in Embodiment 4 of the present proposal enables provision of a heater enabling suppression of a non-sheet feeding portion temperature increase and improvement of evenness of a heat generation distribution in a sheet feeding area, and an image heating apparatus including the heater.

Embodiment 5

Figure 11:
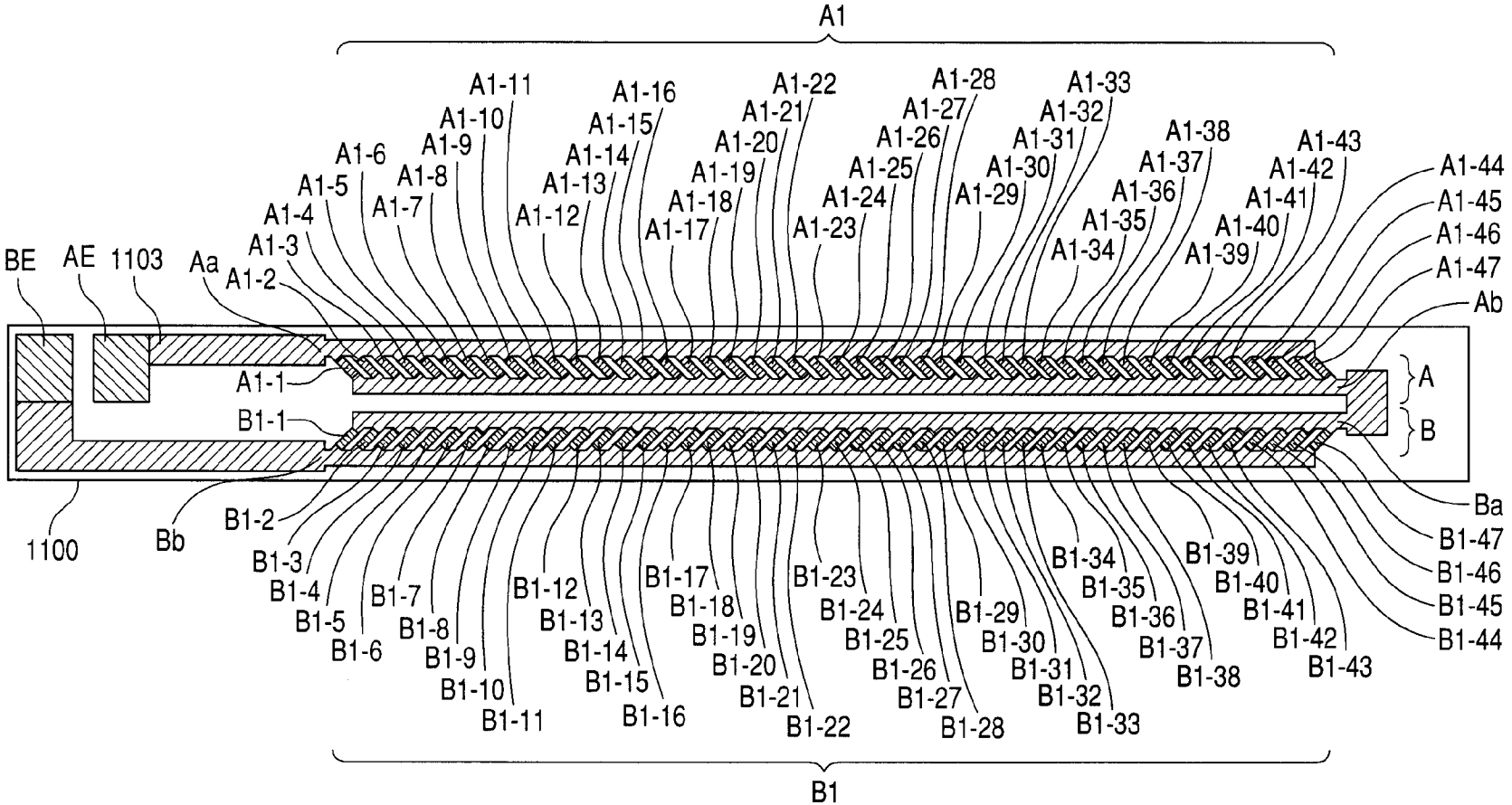
FIG. 11 is a diagram illustrating a configuration of a heater in Embodiment 5.

Next, Embodiment 5 in which changes have been made to a heater to be installed in an image heating apparatus will be described. A description of components similar to those in Embodiment 4 will be omitted. FIG. 11 is a diagram illustrating a configuration of a heater 1100 in Embodiment 5.

A heat generation line A (first line) includes one heat generation block A1, and a heat generation line B (second line) also includes one heat generation block B1. A conductive trace 1103 is also provided. The heat generation line A and the heat generation line B are electrically connected in series. Power is supplied to the heat generation lines A and B from electrodes AE and BE, to which a power supply connector is connected. The heat generation line A includes a conductive trace Aa (first conductive member in the heat generation line A) provided along a substrate longitudinal direction, and a conductive trace Ab (second conductive member in the heat generation line A) provided along the substrate longitudinal direction at a position that is different in a lateral direction of the substrate from that of the conductive trace Aa.

A plurality of (47 in the present embodiment) heat generation resistive members (A1-1 to A1-47) are electrically connected in parallel between the conductive trace Aa and the conductive trace Ab, thereby forming the heat generation block A1. In other words, the heat generation line A is formed by one heat generation block A1. The configuration of the heat generation line B is similar to that of the heat generation line A, and thus, a description thereof will be omitted.

As described in Embodiment 4, in the heater 1100 in Embodiment 5, also, each of a plurality of heat generation resistive members included in one heat generation block is set so that a heat generation resistive member arranged at an end portion in the longitudinal direction has a higher resistivity value compared to a heat generation resistive member arranged in the center in the longitudinal direction. As described above, the heater 1100 in Embodiment 5, in which a heat generation line is formed by one heat generation block, also enables suppression of a non-sheet feeding portion temperature increase.

REFERENCE SIGNS LIST

100 mage heating apparatus
200 heater
A heat generation line A (first line)
B heat generation line B (second line)
A1 to A20 heat generation block in heat generation line A
B1 to B20 heat generation block in heat generation line B
Aa, Ab conductive trace in heat generation line A
Ba, Bb conductive trace in heat generation line B
A1-1 to A20-8, B1-1 to B20-8 heat generation resistive member.

The invention claimed is:

1. A heater comprising:

an elongated substrate having a longer longitudinal dimension in a longitudinal direction thereof than a lateral dimension in a lateral direction thereof; and a heat generation block formed on the substrate, wherein the heat generation block includes;

a first conductive member provided on the substrate along the longitudinal direction of the substrate; and a second conductive member provided on the substrate along the longitudinal direction at a position that is different in the lateral direction of the substrate from that of the first conductive member, and a plurality of heat generation resistive members electrically connected in parallel between the first conductive member and the second conductive member, each heat generation resistive member having a positive temperature coefficient of resistance, wherein the heater satisfies at least either of:

in the heat generation block, one of the heat generation resistive members arranged at an end portion in the longitudinal direction of the substrate has a resistivity value higher than that of one of the heat generation resistive members arranged at a center portion in the longitudinal direction of the substrate; or the distance between corresponding points on adjacent heat generation resistive members included in the heat generation block is larger in the end portion in the longitudinal direction of the substrate than in the center portion in the longitudinal direction of the substrate.

2. A heater according to claim 1, wherein a plurality of the heat generation blocks are provided along the longitudinal direction, and the plurality of the heat generation blocks are electrically connected in series.

3. A heater according to claim 1, wherein the plurality of heat generation resistive members are arranged with an oblique inclination relative to the longitudinal direction, and each of the plurality of heat generation resistive members included in one of the heat generation blocks has a resistivity value that is different from that in an adjacent one of the heat generation blocks.

4. A heater according to claim 1, wherein the heater comprises a plurality of heat generation lines, each of the plurality of heat generation lines including the heat generation block, in the recording material conveyance direction.

5. A heater according to claim 1, wherein each of the heat generation resistive members has a rectangle shape, and wherein an area between both ends of one of the heat generation resistive members in the longitudinal direction of the substrate overlaps a next area between both ends of a next heat generation resistive member next to the one of the heat generation resistive member in the longitudinal direction of the substrate.

6. An image heating apparatus comprising:

an endless belt;

a heater that is in contact with an inner surface of the endless belt; and a nip portion forming member that forms a nip portion together with the heater through the endless belt, wherein a recording material bearing an image is heated while being pinched and conveyed by the nip portion, wherein the heater comprises the heater according to claim 1.

7. An apparatus according to claim 6, wherein a plurality of the heat generation blocks are provided along the longitudinal direction, and the plurality of the heat generation blocks are electrically connected in series.

8. An apparatus according to claim 6, wherein the plurality of heat generation resistive members are arranged with an oblique inclination relative to the longitudinal direction, and each of the plurality of heat generation resistive members included in one of the heat generation blocks has a resistivity value that is different from that in an adjacent one of the heat generation blocks.

9. An apparatus according to claim 6, wherein the heater comprises a plurality of heat generation lines, each of the plurality of heat generation lines including the heat generation block, in the recording material conveyance direction.

10. An apparatus according to claim 6, wherein each of the heat generation resistive members has a rectangular shape, and wherein an area between both ends of one of the heat generation resistive members in the longitudinal direction of the substrate overlaps an next area between both ends of a next heat generation resistive member next to the one of the heat generation resistive member in the longitudinal direction of the substrate.

11. A heater according to claim 4, wherein each of heat generation lines is controllable independently.

12. An apparatus according to claim 9, wherein each of heat generation lines is controllable independently.

13. A heater according to claim 1, wherein each of heat generation resistive members includes a PTC resistive element.

14. An apparatus according to claim 6, wherein each of heat generation resistive members includes a PTC resistive element.

* * * * *